US009377263B1

(12) United States Patent
Sy

(10) Patent No.: US 9,377,263 B1
(45) Date of Patent: Jun. 28, 2016

(54) MUZZLE BRAKE CONCUSSION REDUCING DEVICE FOR FIREARMS AND ASSOCIATED MUZZLE BRAKES AND COMPENSATORS

(71) Applicant: Ferdinand Sy, San Dimas, CA (US)

(72) Inventor: Ferdinand Sy, San Dimas, CA (US)

(73) Assignee: Ferfrans Inc., Montclair, CA (US)

( * ) Notice: Subject to any disclaimer, the term of this patent is extended or adjusted under 35 U.S.C. 154(b) by 0 days.

(21) Appl. No.: 14/187,725

(22) Filed: Feb. 24, 2014

(51) Int. Cl.
*F41A 21/36* (2006.01)
*F41A 21/34* (2006.01)
*F41A 21/32* (2006.01)

(52) U.S. Cl.
CPC ..... *F41A 21/36* (2013.01); *F41A 21/325* (2013.01); *F41A 21/34* (2013.01)

(58) Field of Classification Search
CPC ..... F41A 21/30; F41A 21/325; F41A 21/36; F41A 21/38; F41A 21/32; F41A 5/12; F41A 25/00; F41A 25/26; F41A 35/00; F41A 13/06; F41C 27/00
USPC ..... 89/177, 14.3, 14.2, 14.4, 198, 1.06
See application file for complete search history.

(56) References Cited

U.S. PATENT DOCUMENTS 5,092,223 A * 3/1992 Hudson ..... 89/14.2
5,357,842 A * 10/1994 Reynolds ..... F41A 21/36 89/14.3
5,367,940 A * 11/1994 Taylor ..... F41A 21/36 89/14.3
5,698,810 A * 12/1997 Rose ..... 89/14.3
5,814,757 A * 9/1998 Buss ..... F41A 21/36 89/14.3
9,080,829 B1 * 7/2015 Cellini ..... F41A 21/36
2011/0271575 A1 * 11/2011 Overbeek Bloem .. F41A 21/325 42/90

* cited by examiner

*Primary Examiner* — Troy Chambers
*Assistant Examiner* — Bridget Cochran
(74) *Attorney, Agent, or Firm* — Ramoncito M. Valencia

(57) ABSTRACT

This invention is directed to muzzle devices for firearms and, in particular, to muzzle brakes and compensators ("Muzzle Devices"). More specifically, but without restriction to the particular embodiments hereinafter described in accordance with the best mode of practice, this invention relates to a concussion reducing device ("CRD") associated with said Muzzle Devices.

4 Claims, 8 Drawing Sheets

MUZZLE BRAKE CONCUSSION REDUCING DEVICE FOR FIREARMS AND ASSOCIATED MUZZLE BRAKES AND COMPENSATORS

BACKGROUND OF THE INVENTION

The present invention is directed to a device that minimizes side blast or concussion resulting from expanding propellant gases exiting out of side ports from a Muzzle Device of a firearm upon firing of a projectile from said firearm. Certain embodiments, described below, also reduce muzzle flash from propellant gasses in addition to minimizing side concussion.

A muzzle brake is a device attached to the muzzle of a firearm that reduces felt recoil (rearward movement) and counters lateral (vertical, diagonal and horizontal) movement of the firearm's muzzle upon firing of said firearm while a compensator reduces lateral and horizontal muzzle movement with minimal reduction in felt recoil. This is achieved by redirecting expanding propellant gasses and the direction force exerted on the firearm by said expanding propellant gasses sideways through a plurality of side ports which results in said mitigation of felt recoil and improved muzzle control. Since the side ports redirect expanding propellant gasses sideways, it creates an issue when the shooter is shooting prone (on or near the ground) because the side directed gasses blow debris and dust toward the shooter as illustrated in FIG. 8. This prevents the shooter from making quick follow-up shots since the shooters vision may be temporarily impaired by the stirred-up debris and dust.

Reduction in muzzle movement upon firing a firearm is highly desired in combat and competitive shooting hence most competitive shooters use a muzzle brake. This allows for quicker and more accurate follow-up shots on semi-auto mode and also increases precision on fully automatic mode. There are a number of muzzle devices on the market that work well in reducing such muzzle movement including those described in U.S. Pat. No. 7,954,414 entitled "Muzzle Brake" issued Jun. 7, 2011 and US Patent Application Publication No. 2011/0271575 entitled "Muzzle Devices and Methods of Tuning Thereof" published Nov. 10, 2011; with the prior disclosing a muzzle brake and the later a compensator, both of which are hereby incorporated by reference herein. These devices, although purported to reduce side blast still direct a substantial amount of propellant gasses and sideways thereby distracting fellow shooters and kicks up ample dust and debris when shooting prone or in dusty environments.

The present invention is intended to be used in conjunction with a Muzzle Device (muzzle brakes or compensators) to reduce or nearly eliminate undesired side-blast or concussion from the Muzzle Devices. The preferred embodiment of the CRD of the present invention comprises, a cylindrical body with a proximal and distal end that fits around or covers a Muzzle Device, a plurality of exhaust ports or vents of a predetermined size, shape, arrangement and quantity, around the cylindrical body of the CRD allow proper venting of expanding propellant gases from the Muzzle Device to thereby enable the Muzzle Device to still function, i.e., minimize felt recoil and muzzle movement upon firing of a projectile, when said CRD is in place. The CRD also includes a means for attaching the CRD to a Muzzle Device and an annular wall around the distal end. The annular wall may be flat concave, or convex in shape and include one or more forward exhaust ports.

The CRD of the present invention basically covers the radial ports of the Muzzle Device and acts as a diffuser of expanding propellant gases upon firing of a firearm thereby reducing the side blast by redirecting most of the expanding gasses forward yet allowing enough gasses to exit laterally thus resulting in reduced lateral muzzle movement of the firearm with minimal side blast.

The CRD of the present invention is novel in that it is an all-in-one system, in a preferred embodiment of the present invention, the CRD includes a quick connect/disconnect functionality. The aforementioned plurality of strategically placed ports to allow the muzzle brake to perform similarly to how it would perform without the CRD in place, i.e., reduces muzzle movement and recoil when firing a shot thereby allowing for quick follow-up shots. The ports on the CRD is key to this system as it allows most of the blast to be directed forward but still allows the brake to function fairly normally.

The above described and many other features and attendant advantages of the present invention will become better understood by reference to the following detailed description when taken in conjunction with the accompanying figures.

BRIEF DESCRIPTION OF THE DRAWINGS

Further objects of the present invention together with additional features contributing thereto and advantages accruing therefrom will be apparent from the following description of the preferred embodiments of the invention which are shown in the accompanying drawing figures with like reference numerals indicating like components throughout wherein.

DETAILED DESCRIPTION OF THE INVENTION

The present invention is directed to a device that reduces muzzle flash and side blast or concussion resulting from expanding gases exiting out of ports from a Muzzle Device of a firearm upon firing of a projectile from said firearm. Aspects of the present invention disclosed herein have also been presented in U.S. Provisional Application No. 61/748,842 which is hereby incorporated by reference in its entirety as if fully repeated herein.

Figure 10A:
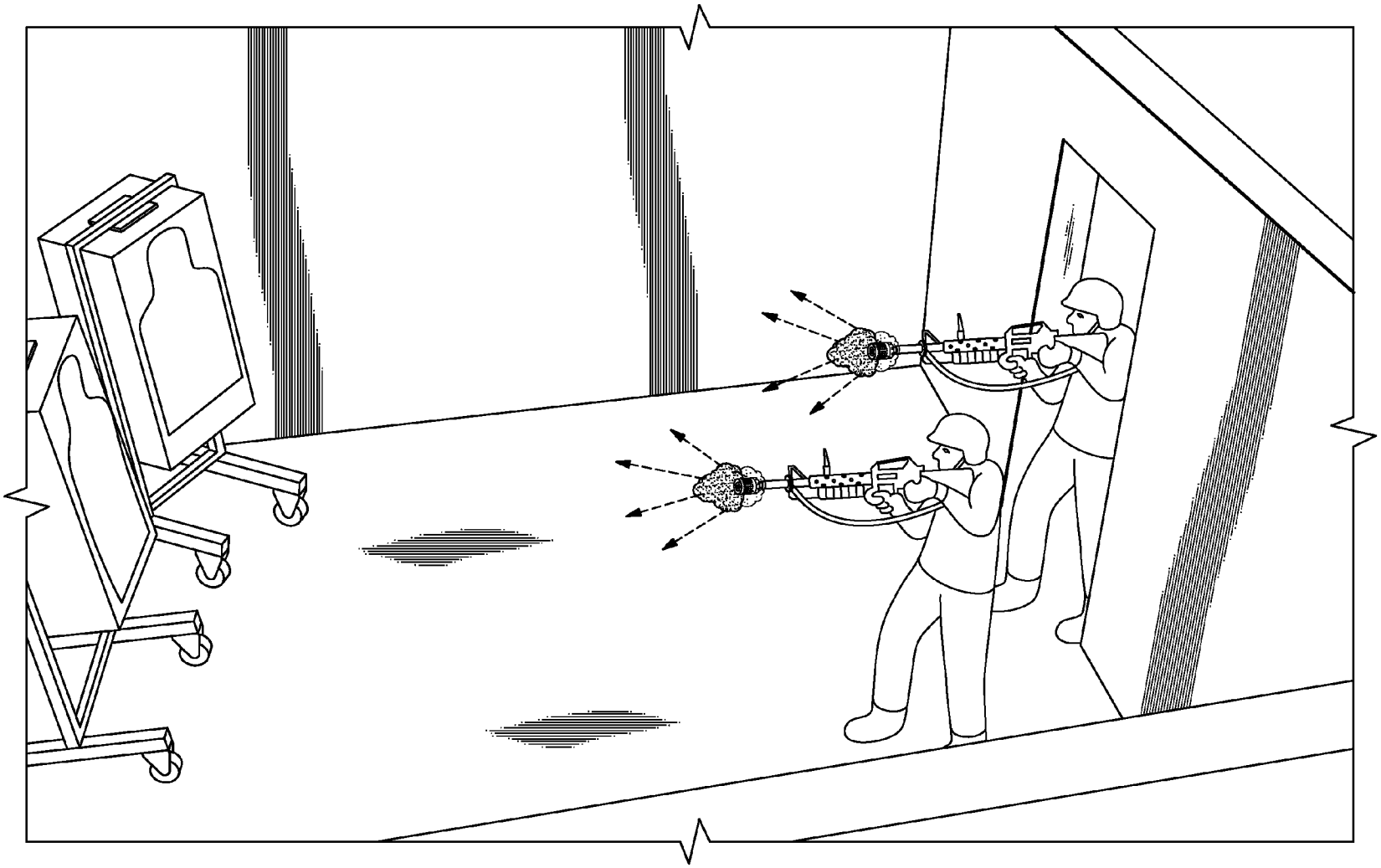
FIG. 10A is a pictorial representation of a muzzle brake in a close quarter battle or combat use.
Figure 10B:
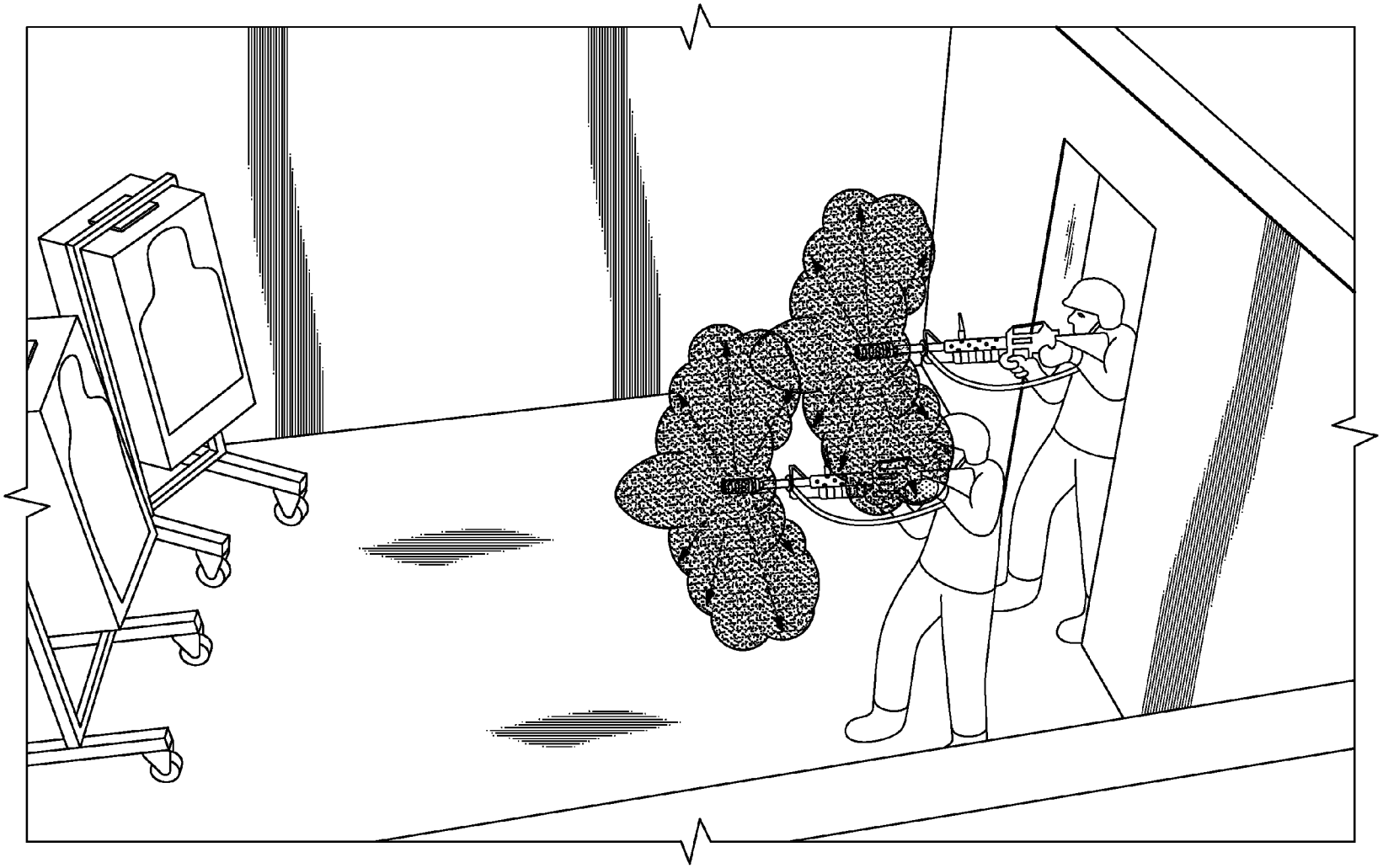
FIG. 10B is a pictorial representation of the CRD (100) of the present invention in a close quarter battle or combat use.

Muzzle Devices work by redirecting expanding propellant gasses exiting the muzzle of a firearm toward the sides or radially around the muzzle to counteract the horizontal, vertical and rearward forces resulting from firing of the bullet out of the firearm and expanding propellant gasses. The issue with such Muzzle Devices is that most of the expanding gases are now directed to the sides of the muzzle which causes unwanted side blast or concussion and is distracting to individuals to the side of the weapon being fired. This issue is even more pronounced in an urban environment (close quarter battle (CQB) or combat) such as those typically encountered by law enforcement and military when entering a building and clearing hallways and rooms, where teammates typically shoot next to each other where the concussion from expanding gasses is very distracting to fellow team members when trying to make accurate shots or identifying friend from foe in dynamic, high stress, and high-risk situations (FIGS. 10A and 10B). It is thus very important to prevent such distraction in a life or death situation while also allowing the shooters to fire multiple accurate shots by use of Muzzle Devices that minimise muzzle movement. As mentioned above, Muzzle Devices stabilizes the firearm upon firing thereby allowing the shooter to make quick accurate multiple shots on target. So the use of a Muzzle Device allowing with the CRD of the present invention is indeed highly desirable to increase survivability and decrease unwanted casualties from high risk military and law enforcement encounters.

Another issue with using Muzzle Devices such as muzzle brakes and compensators is that it directs dust and debris toward the shooters face and eyes which prevent the shooter from making follow-up shots when shooting on or near the ground or in a dusty environment. This is relevant is desert combat situations as well as in shooting competitions when milliseconds make the difference between winning and losing. Making quick follow-up shots when shooting prone is a must, especially when faced with a fast moving enemy force in desert combat.

Yet another issue with muzzle brakes is that they increase the flash signature the firearm which is highly undesirable in low light or night time combat situations because it gives away the position of the shooter. So the dilemma is that shooters including soldiers would like to use muzzle brakes to enable them to shoot targets more effectively and efficiently but due to the increased flash signature and side blast they most often end up using flash suppressors instead of a muzzle brake or compensator. Flash suppressors of flash hiders, although great at reducing flash from the muzzle of a firearm, does not reduce muzzle movement and recoil which makes it difficult to fire quick follow-up shots and also makes it difficult to control their firearms when shooting in fully automatic mode.

There is therefore a unmet need for a device that reduces muzzle movement, muzzle flash and concussion resulting from firing of a firearm. The object, therefore, of the present invention is to provide such a device, the CRD (100), that reduces muzzle movement, muzzle flash and concussion resulting from firing of a firearm thereby allowing shooters to make fast, multiple hits on target with drastically reduced side blast.

Figure 1:
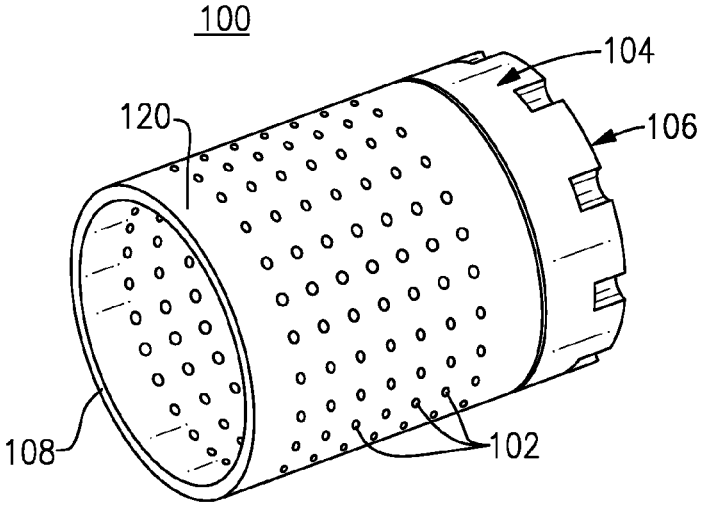
FIG. 1 is a front side view illustrating a preferred embodiment of the Concussion Reducing Device (CRD) (100) of the present invention.

The device of the present invention is a system wherein a Muzzle Device (200) is used in conjunction with the CRD (100) of the present invention thereby allowing the Muzzle Device (200) to function as designed while diffusing the expanding propellant gases escaping from the side ports of the Muzzle Device and directing most of the gasses forward to minimize the side blast or concussion and also minimize flash signature by use of a flash hider. An example of such device, and a preferred embodiment of the present invention, is shown in FIG. 1, illustrating the CRD (100) having a plurality of gas exhaust vents or ports (102) located radially along a cylindrical body (120) of the CRD (100). The CRD (100) includes a means for attaching it to the Muzzle Device (200) such as, for example, a quick connect with a lock-ring (104), as shown in FIG. 1. Alternatively, connection between the CRD (100) and the Muzzle Device (200) may also be a screw-on (threaded), press fit, clip-on, clamp-on type attachment or any other means for attaching the CRD (100) to the Muzzle Device (200) including, but not limited to, attachments disclosed in U.S. patent application Ser. No. 13/102,819 entitled, "Systems for Attaching a Noise Suppressor to a Firearm", published on Aug. 25, 2011, Pub. No. US 2011/0203152 A1; U.S. Pat. No. 8,555,765 entitled "Systems Methods and Devices for Attaching a Suppressor to a Firearm", issued Oct. 15, 2013 and U.S. Pat. No. 8,499,676 entitled "Coupler System for Attaching Blank Adaptor and the like to a Flash Hider" issued Aug. 6, 2013, all of which are hereby incorporated by reference in their entirety as if fully repeated herein. There are a number of Muzzle Devices on the market that already allow attachment of sound suppressors, such as those described in U.S. Pat. No. 7,954,414 entitled "Muzzle Brake", which is hereby incorporated by reference in its entirety as if fully repeated herein, so the CRD of the present invention may be fitted with a myriad of attachments to fit those Muzzle Devices.

Figure 2:
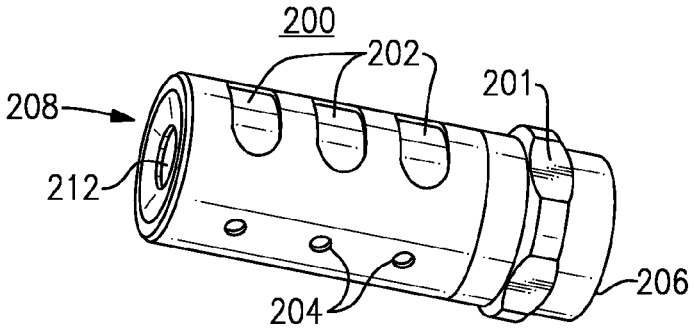
FIG. 2 shows a muzzle brake which is a preferred embodiment of the Muzzle Device (200) of the present invention.
Figure 3:
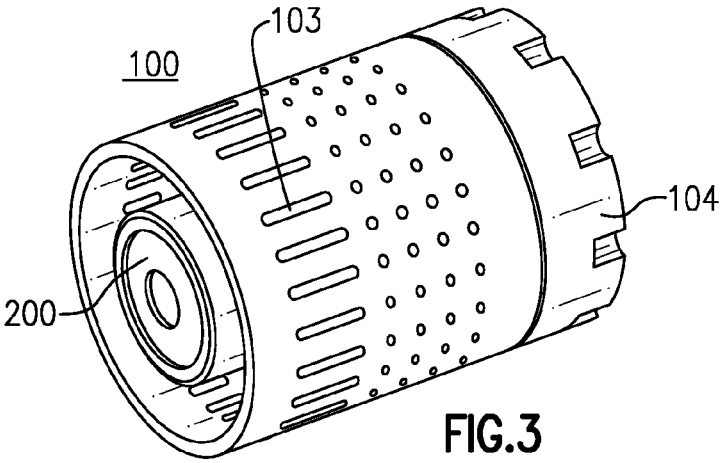
FIG. 3 depicts the CRD (100) attached to the Muzzle Device (200) of the present invention.

With reference to FIGS. 1, 2 and 3, the CRD (100) of the present invention is comprised of a cylindrical body (120) with a proximal (106) and distal end (108). The cylindrical body (120) fits around or covers the Muzzle Device (200) and may include a plurality of exhaust ports or vents (102) of a predetermined size, shape, arrangement and quantity, around the cylindrical body of the CRD that allow proper venting of expanding propellant gases from the Muzzle Device (200) to thereby enable the Muzzle Device (200) to function properly, i.e., minimize felt recoil and muzzle movement upon firing of a projectile. The CRD (100) also includes a means for attaching the CRD (100), such as the illustrated locking mechanism (104), to the Muzzle Device (200). The CRD (100) may also include an annular wall around the distal end (108). The annular wall may be flat concave, or convex in shape and include one or more forward exhaust ports such as, for example and for illustration purposes, the "axial end face" disclosed in U.S. patent application Ser. No. 13/048,759 entitled "Muzzle Device and Methods of Tuning Thereof" published Nov. 10, 2011, Pub. No. US 2011/0271575, which is hereby incorporated by reference as if fully repeated herein. The plurality of exhaust ports or vents (102) may include longitudinal ports (103) shown in FIG. 3.

Figure 6:
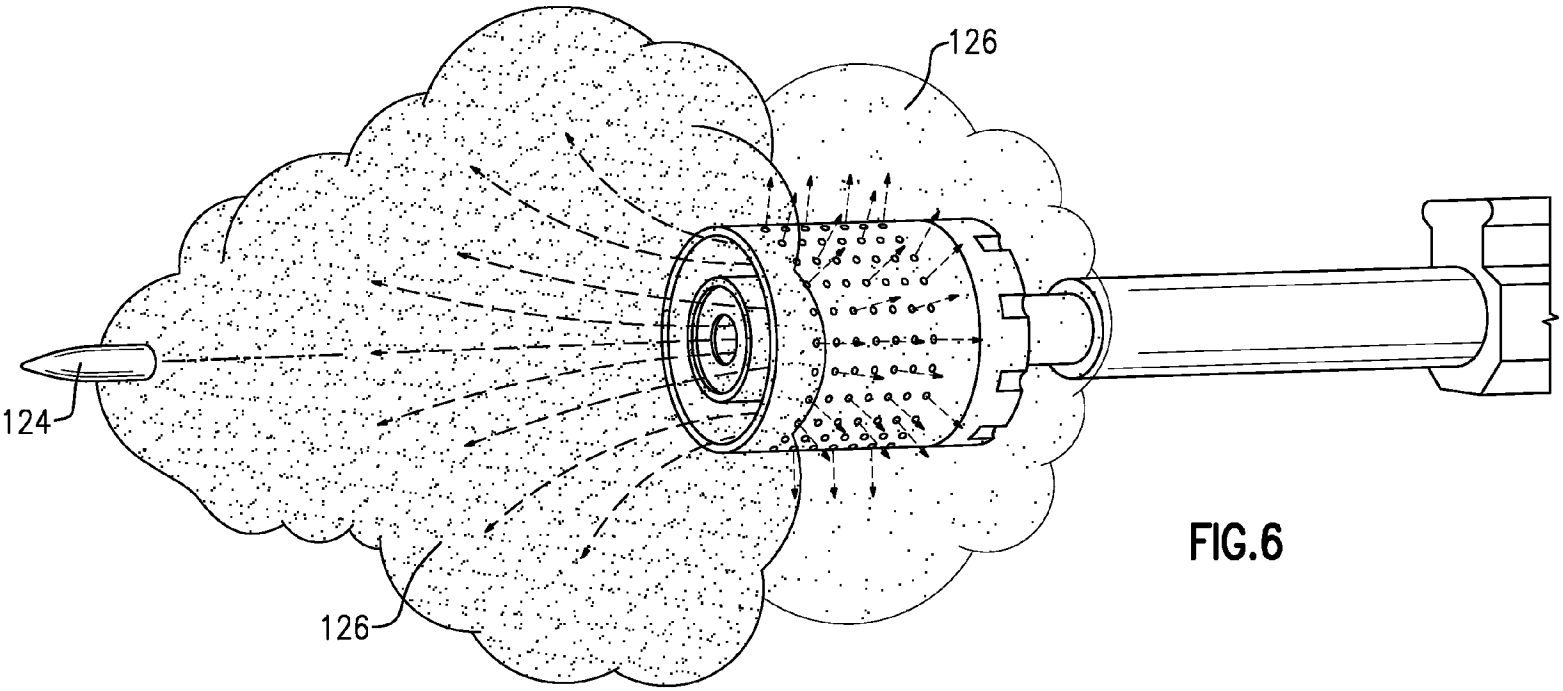
FIG. 6 depicts a CRD (100) in use showing a bullet (124) leaving the Muzzle Device (200) and the expanding propellant gasses (arrows, 126)

With reference to FIGS. 2 and 3, the CRD (100) of the present invention basically covers the radial ports (202 and 204) of the Muzzle Device (200) and acts as a diffuser of expanding propellant gases upon firing of a firearm thereby reducing the side blast by redirecting a majority of the expanding gasses forward yet allowing enough gasses to exit laterally thus resulting in reduced lateral muzzle movement of the firearm with minimal side blast as illustrated in FIG. 6.

The most effective device for minimizing muzzle movement and felt recoil is a well-designed muzzle brake such as the preferred embodiment of a muzzle brake of the present invention depicted in FIG. 2. The muzzle brake (200) has a proximal (206) and distal (208) end and is comprised of a plurality of side ports (202), top ports (204), a bullet exit port (212) and locking lugs (201) near the proximal end (206). The muzzle brake (200) is attached to the end of the barrel (muzzle) of a firearm at the proximal end (206).

Figure 4:
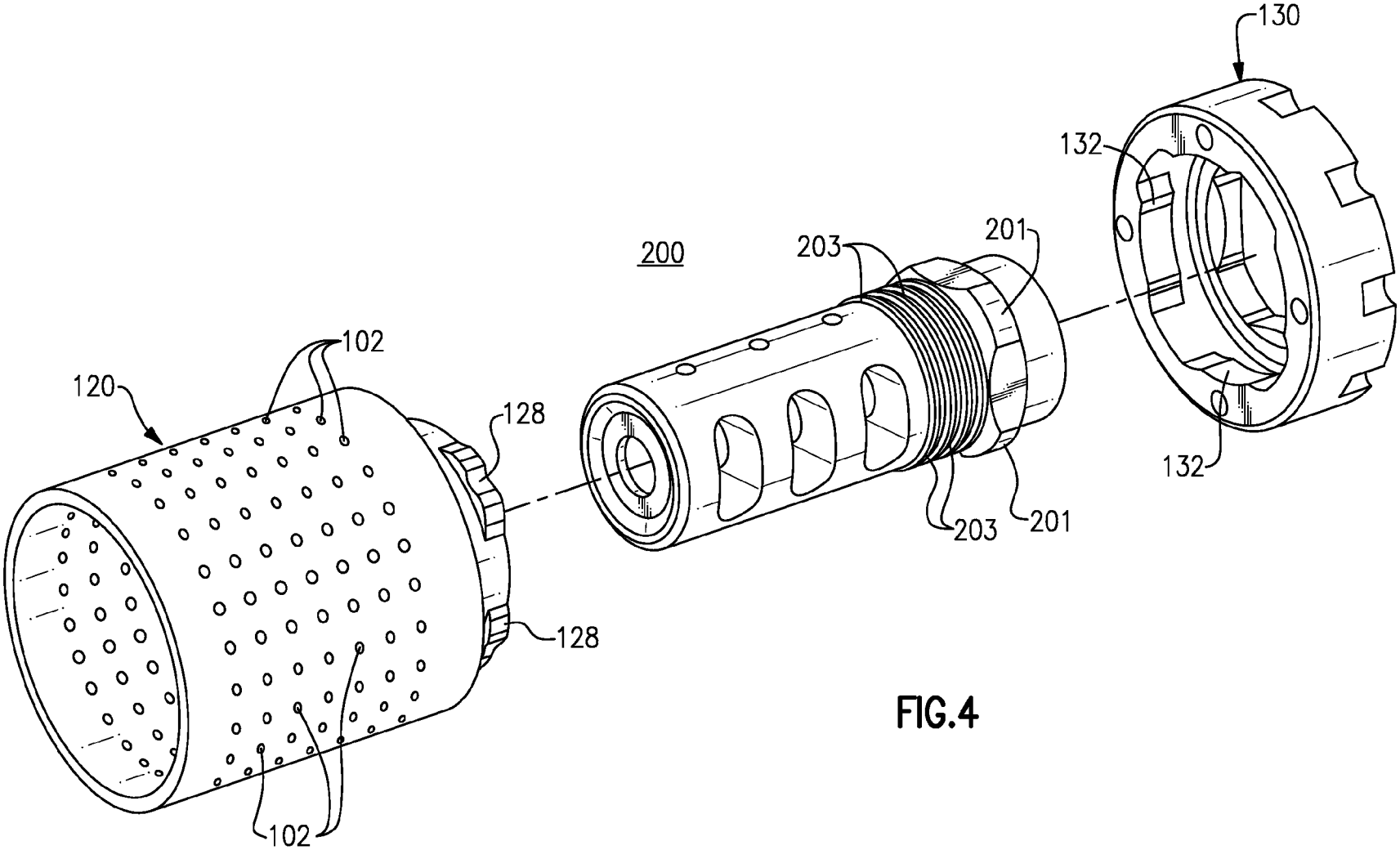
FIG. 4 is a blown up view of the CRD (100) and the muzzle device (200) of the present invention.

The next figure, FIG. 4 shows a blown up view of the components of the CRD (100) and the muzzle brake (200) of the present invention illustrating a preferred embodiment of the locking mechanism of the present invention. The cylindrical body (120) of the CRD comprises multiple ports (102) and CRD locking lugs (128) that interphase with the muzzle brake locking lugs (201) and the lock ring (130) locking lugs (132) such that when engaged, the CRD (100) is locked in place. A preferred embodiment of the muzzle brake may comprise lands (203) on the brake where cylindrical body (120) sits on the muzzle brake (200).

Muzzle brakes, as discussed above, produce very pronounced side blast or concussion with an increase in muzzle flash. Thus, the preferred embodiment of the present invention is to use the CRD (100) in conjunction with a muzzle brake (200). The CRD (100) of the present invention acts as a diffuser of both side blast or concussion and flash signature without hindering the function of the muzzle brake thereby resulting in a highly desired combination that minimizes muzzle movement, felt recoil, side blast or concussion and flash signature.

Figure 5:
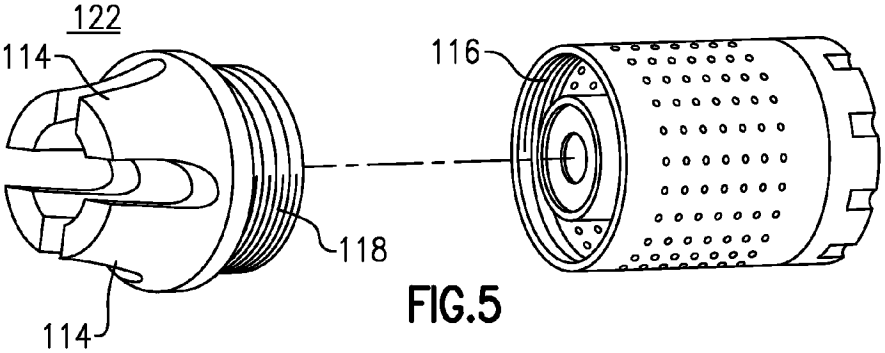
FIG. 5 illustrates a modular CRD (100) that allows attachment for a flash hider (122)

With reference now to FIG. 5, the CRD (100) of the present invention may also be fitted with a flash suppressing unit or flash hider attachment (122) at the distal end (108) of the CRD (100). The flash suppressing unit (112) includes a plurality of prongs or tines (114) that allow expanding combustion gasses to exit between the adjacent gaps between the prongs (114). This allows the gasses to expand through the adjacent gaps thereby helping cool the gasses as they exit and reduce the flash signature of the combustion gasses. The flash hider (122) may be connected to the distal end of the CRD cylindrical body (120) using threads (118) on the flash hider that threads into the CRD body threads (116). Examples of a flash hiders are described in U.S. Pat. No. 8,490,534 entitled "Flash Hider" issued Jul. 23, 2013 and U.S. Pat. No. 5,596,161 entitled "Muzzle Flash Suppressor" issued Jan. 21, 1997, all of which are hereby incorporated by reference in their entirety as if fully repeated herein.

Moving now to FIG. 6, it shows the CRD (100) of the present invention is use. The arrows indicate the direction of concussive force from the expanding propellant gasses. The illustration also shows a bullet (124) exiting the muzzle. The majority of such concussive force is directed forward and away from the shooter yet ample gas passes through the CRD side ports (102) to stabilize or minimize movement of the gun upon firing by counteracting the lateral forces acting upon the muzzle.

Figure 7:
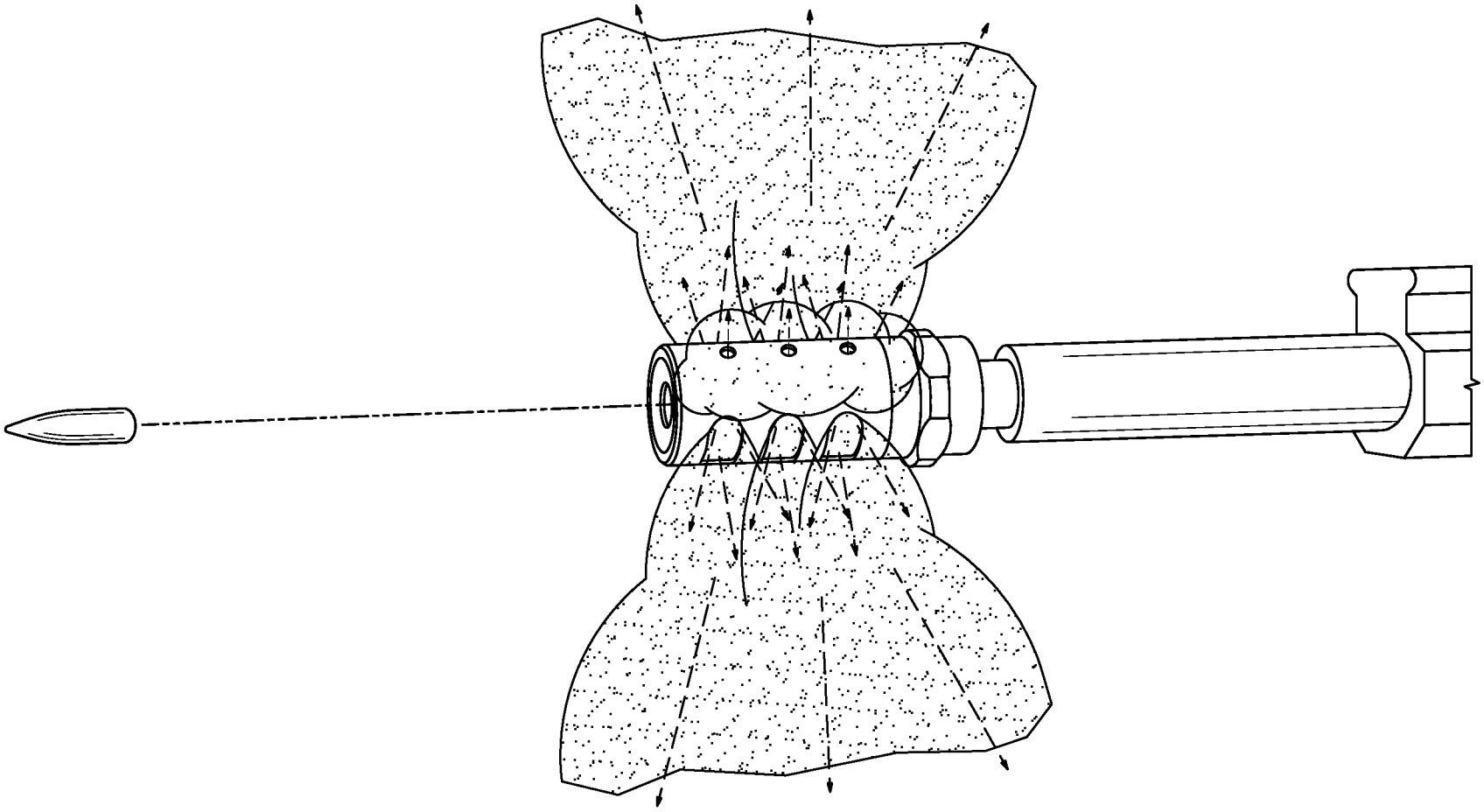
FIG. 7 shows a muzzle brake without the CRD (100) and expanding propellant gasses (arrows, 126) directed sideways causing unwanted side blast or concussion.

With reference now to FIG. 7, without the CRD, on the other hand, almost all of the concussive force is directed sideways through the side ports (202) of the Muzzle Device (200). The concussive force and the sound coming of the side ports (202) are substantial enough that it is very distracting to those standing adjacent to the Muzzle Device.

Figure 8:
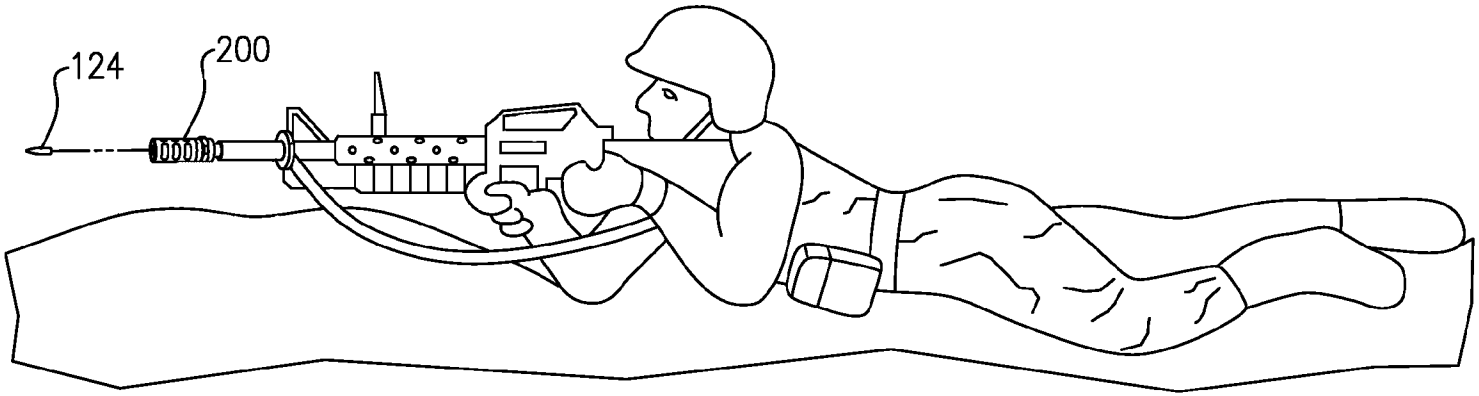
FIG. 8 illustrates the unwanted side blast directing debris and dust back toward the shooter who is shooting a prone position.

Furthermore, as illustrated in FIG. 8, the side blast from a bare Muzzle Device (200) kicks up and directs dust and debris back toward the shooter when shooting on the ground, near dusty surfaces or near surfaces with loose matter. This is highly undesirable as the dust and debris blocks the shooters view of the target preventing the shooter from making follow-up shots or positively identifying other potential threats or friendlies.

Figure 9:
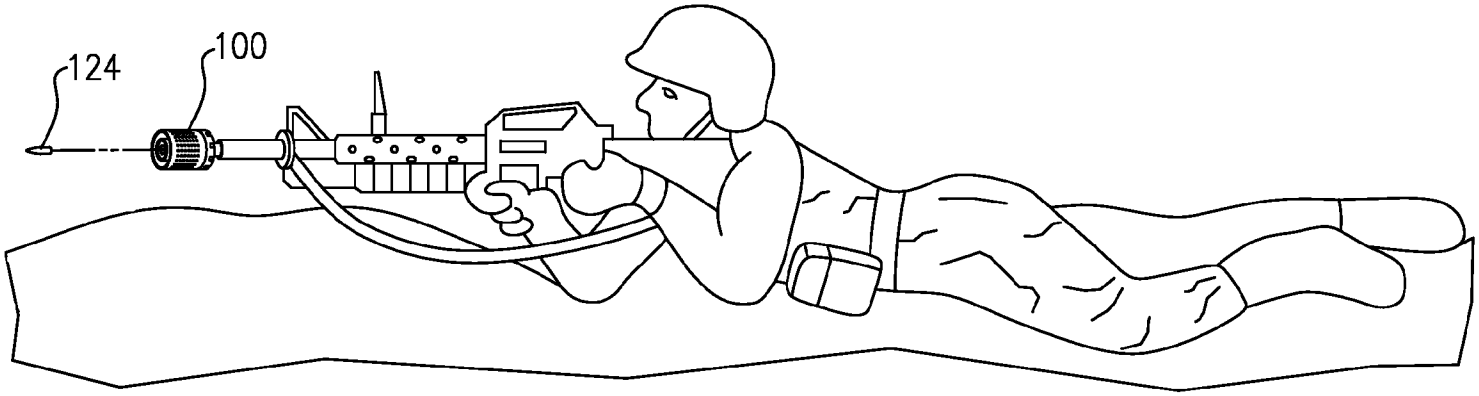
FIG. 9 shows the CRD (100) directing a majority of the expanding propellant gasses forward thereby eliminating the side blast and preventing debris and dust from distracting the shooter shooting in prone.

The next figure, FIG. 9, shows how the CRD (100) of the present invention solves the above-mentioned issue by redirecting the concussive force forward thereby directing dust and debris forward which is not distractive to the shooter allowing the shooter to make accurate follow-up shots and quick positive identification of other targets and friendlies. It is extremely important for police and military to be able to shoot the correct target and identify non-threats thus preventing injury or death of innocent civilians and/or friendlies.

As alluded to above, police and military often have to search for targets in a closed environment such as buildings, schools, homes, caves and other enclosed structures. This is called close quarter combat or battle (CQB). It is extremely important for members of an entry team to move in an ordered formation and not get distracted by side concussion from their teammates' firearms. Side concussion or blast from muzzle brakes prevents shooters from making accurate shots and prevents quick identification of targets and non-threats.

FIG. 10A, shows the CRD (100) of the present invention directing the concussive force (arrows) forward. This prevents the concussive force from distracting team members standing next to each other thereby allowing entry team members to quickly identify and accurately shoot threats and also identify non-threats thereby reducing the possibility of shooting innocent folks.

With a bare muzzle brake, however, FIG. 10B, shows the concussion or side blast and hot gasses (arrows) directed toward the face of the shooter standing next to the muzzle brake of his teammate. This is extremely distracting and would prevent this shooter from quickly identify and accurately shoot targets which could get them shot and killed. The distraction would also prevent them from properly identifying non-threats which can result in unintended casualties.

Figure 11:
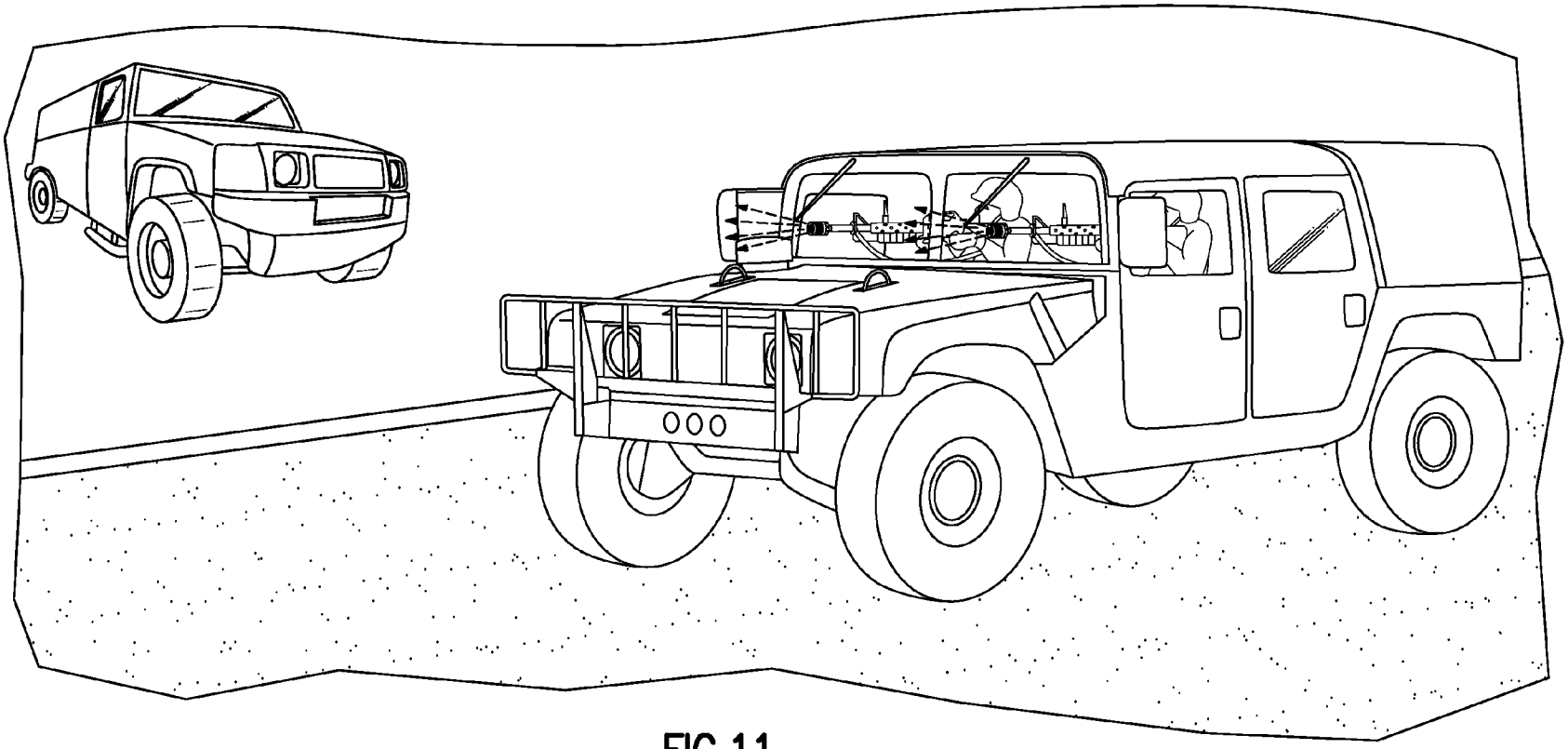
FIG. 11 represents the CRD of the present invention being used inside a vehicle.

Yet another example of the usefulness of the CRD (100) of the present invention is illustrated in FIG. 11. Military and police sometimes encounter hostiles while patrolling the streets in their vehicles that necessitate them to shoot from inside their vehicles. Once again, the CRD, directs concussive force and sound forward thereby allowing the shooters to shoot unimpeded by the muzzle brake on their firearms. This provides a distinct advantage to police and military and may mean the difference between them getting injured or prevailing in a firefight.

The key to the present invention is that the CRD is used in conjunction with a Muzzle Device (muzzle brake and compensators) to stabilise the firearms in a gunfight allowing shooters to make fast and accurate shots and quickly identify friend from foe without the undesired side blast and flash coming from the Muzzle Device. There is no other device on the available that does this.

CONCLUDING STATEMENT

All patents, provisional applications, patent applications and other publications mentioned in this specification are herein incorporated by reference.

While this invention has been described in detail with reference to certain preferred embodiments, it should be appreciated that the present invention is not limited to those precise embodiments. Rather, in view of the present disclosure, which describes the current best mode for practicing the invention, many modifications and variations would present themselves to those of skill in the art without departing from the scope and spirit of this invention. The scope of the invention is, therefore, indicated by the following claims rather than by the foregoing description. All changes, modifications, and variations coming within the meaning and range of equivalency of the claims are to be considered within their scope.

Furthermore, those skilled in the art will recognize, or be able to ascertain, using no more than routine experimentation, many equivalents to the specific embodiments of the invention described herein. Such equivalents are intended to be encompassed by the following claims.

What is claimed is:

1. A firearm concussion reducing device comprising: a first substantially cylindrical shaped body having a proximal and a distal end, so that said first substantially cylindrical shaped body is attached to a firearm at said proximal end using a connection selected from the group consisting of: threaded, quick connect, press-fit, clip-on and snap-on attachments; a muzzle brake comprising a second substantially cylindrical shaped body having side ports so that said side ports redirect expanding propellant gasses to said sides of said muzzle brake so that recoil and muzzle movement of said firearm is reduced upon firing said firearm; at least one top ports on said second substantially cylindrical shaped body of said Muzzle brake that facilitate said expanding propellant gasses in a vertical direction so that muzzle rise of said firearm is minimized upon firing said firearm, and said muzzle brake is removably disposed inside said first substantially cylindrical shaped body thereby defining an annular forward port at the distal end of said first substantially cylindrical shaped body, said annular forward port is defined by a continuous gap between said muzzle brake and the distal end of said first substantially cylindrical shaped body; and a plurality of exhaust vents on said first substantially cylindrical shaped body that penetrate said first substantially cylindrical shaped body, said plurality of exhaust vents have a predetermined size shape and arrangement, some of which being directly across from said side ports of said muzzle brake thereby allowing some of the expanding propellant gasses to directly exit out of said plurality of exhaust vents that are directly across from said side ports of said muzzle brake, while the majority of expanding propellant gasses are redirected in a substantially forward direction out of said annular forward port, thereby reducing side and rearward concussion resulting from said expanding propellant gasses by redirecting the majority of said expanding propellant gasses forward, out of said annular forward port.

2. The concussion reducing device of claim 1 wherein said plurality of exhaust vents on said first substantially cylindrical shaped body are arranged in longitudinal rows along said first substantially cylindrical shaped body.

3. The concussion reducing device of claim 2 wherein said plurality of exhaust vents on said first substantially cylindrical shaped body surround said first substantially cylindrical shaped body.

4. A method of using the first substantially cylindrical shaped body of claim 1 by attaching said first substantially cylindrical shaped body to a firearm.

* * * * *